US011333147B2

(12) United States Patent
Takahashi

(10) Patent No.: US 11,333,147 B2
(45) Date of Patent: May 17, 2022

(54) SCROLL COMPRESSOR INCLUDING AN ORBITING SCROLL HAVING AN ORBITING END PLATE PROVIDED WITH A REAR CONCAVE PORTION

(71) Applicant: DAIKIN INDUSTRIES, LTD., Osaka (JP)

(72) Inventor: Nobuo Takahashi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/931,147

(22) Filed: Jul. 16, 2020

(65) Prior Publication Data

US 2020/0347845 A1 Nov. 5, 2020

Related U.S. Application Data

(63) Continuation of application No. PCT/JP2019/000098, filed on Jan. 7, 2019.

(30) Foreign Application Priority Data

Jan. 17, 2018 (JP) ..... JP2018-005415

(51) Int. Cl.
*F04C 18/02* (2006.01)
*F04C 28/06* (2006.01)
*F04C 23/00* (2006.01)

(52) U.S. Cl.
CPC ..... *F04C 18/0215* (2013.01); *F04C 18/0253* (2013.01); *F04C 28/06* (2013.01); *F04C 23/008* (2013.01)

(58) Field of Classification Search
CPC ..... F04C 18/0253; F01C 1/0253
See application file for complete search history.

(56) References Cited

U.S. PATENT DOCUMENTS 5,127,809 A * 7/1992 Amata ..... F04C 18/0215 418/55.2
2011/0194966 A1 8/2011 Takeuchi et al.

FOREIGN PATENT DOCUMENTS

| | | | |
|---|---|---|---|
| EP | 0 443 705 | A1 | 1/1991 |
| EP | 2 631 484 | A1 | 9/2011 |
| JP | 60-19979 | A | 2/1985 |
| JP | 1-121583 | A | 5/1989 |
| JP | 2001-9075 | A | 1/2001 |
| JP | 2001-99076 | A | 4/2001 |

(Continued)

OTHER PUBLICATIONS

International Search Report of corresponding PCT Application No. PCT/JP2019/000098 dated Apr. 2, 2019.

(Continued)

*Primary Examiner* — Laert Dounis
(74) *Attorney, Agent, or Firm* — Global IP Counselors, LLP

(57) ABSTRACT

A scroll compressor includes an orbiting scroll and a fixed scroll. The orbiting scroll has a disk-shaped orbiting end plate and a spiral wall-shaped orbiting lap protruding from a front surface of the orbiting end plate. The fixed scroll has a spiral wall-shaped fixed lap meshing with the orbiting lap. The orbiting end plate is provided with a rear concave portion that opens in a rear surface of the orbiting end plate and extends along a winding finish portion of the orbiting lap.

7 Claims, 16 Drawing Sheets

(56) References Cited

FOREIGN PATENT DOCUMENTS

| | | | | |
|---|---|---|---|---|
| JP | 2016-79873 | A | | 5/2016 |
| KR | 20030051089 | A | * | 6/2003 |

OTHER PUBLICATIONS

European Search Report of corresponding EP Application No. 19 74 1463.4 dated Oct. 15, 2020.
International Preliminary Report of corresponding PCT Application No. PCT/JP2019/000098 dated Jul. 30, 2020.

* cited by examiner

SCROLL COMPRESSOR INCLUDING AN ORBITING SCROLL HAVING AN ORBITING END PLATE PROVIDED WITH A REAR CONCAVE PORTION

CROSS-REFERENCE TO RELATED APPLICATIONS

This is a continuation of International Application No. PCT/JP2019/000098 filed on Jan. 7, 2019, which claims priority to Japanese Patent Application No. 2018-005415 filed on Jan. 17, 2018. The entire disclosures of these applications are incorporated by reference herein.

BACKGROUND

Field of the Invention

The present disclosure relates to a scroll compressor.

Background Information

A scroll compressor including an orbiting scroll and a fixed scroll has been known. When the scroll compressor stops, the orbiting scroll may turn in a direction reverse to an orbiting direction during the operation of the scroll compressor. When the orbiting scroll rotates in the reverse direction, an excessive load acts on a winding finish portion of an orbiting lap, which may possibly break the orbiting lap. Therefore, in a scroll compressor disclosed in Japanese Unexamined Patent Publication No. 2016-079873, a cut out of a predetermined shape is formed in the winding finish portion of the orbiting lap to reduce the load that acts on the winding finish portion of the orbiting lap during the reverse rotation of the orbiting scroll.

SUMMARY

A first aspect of the present disclosure is directed to a scroll compressor including: an orbiting scroll (50) having a disk-shaped orbiting end plate (51) and a spiral wall-shaped orbiting lap (60) protruding from a front surface (52) of the orbiting end plate (51); and a fixed scroll (40) having a spiral wall-shaped fixed lap (42) meshing with the orbiting lap (60). The orbiting end plate (51) is provided with a rear concave portion (70) that opens in a rear surface (53) of the orbiting end plate (51) and extends along a winding finish portion (63) of the orbiting lap (60).

DETAILED DESCRIPTION OF EMBODIMENTS (S)

A scroll compressor (10) according to an embodiment will be described below. The scroll compressor (10) is connected to a refrigerant circuit (not shown) which allows a refrigerant to circulate therein to perform a refrigeration cycle, and compresses the refrigerant which is a fluid.

General Configuration of Scroll Compressor

Figure 1:
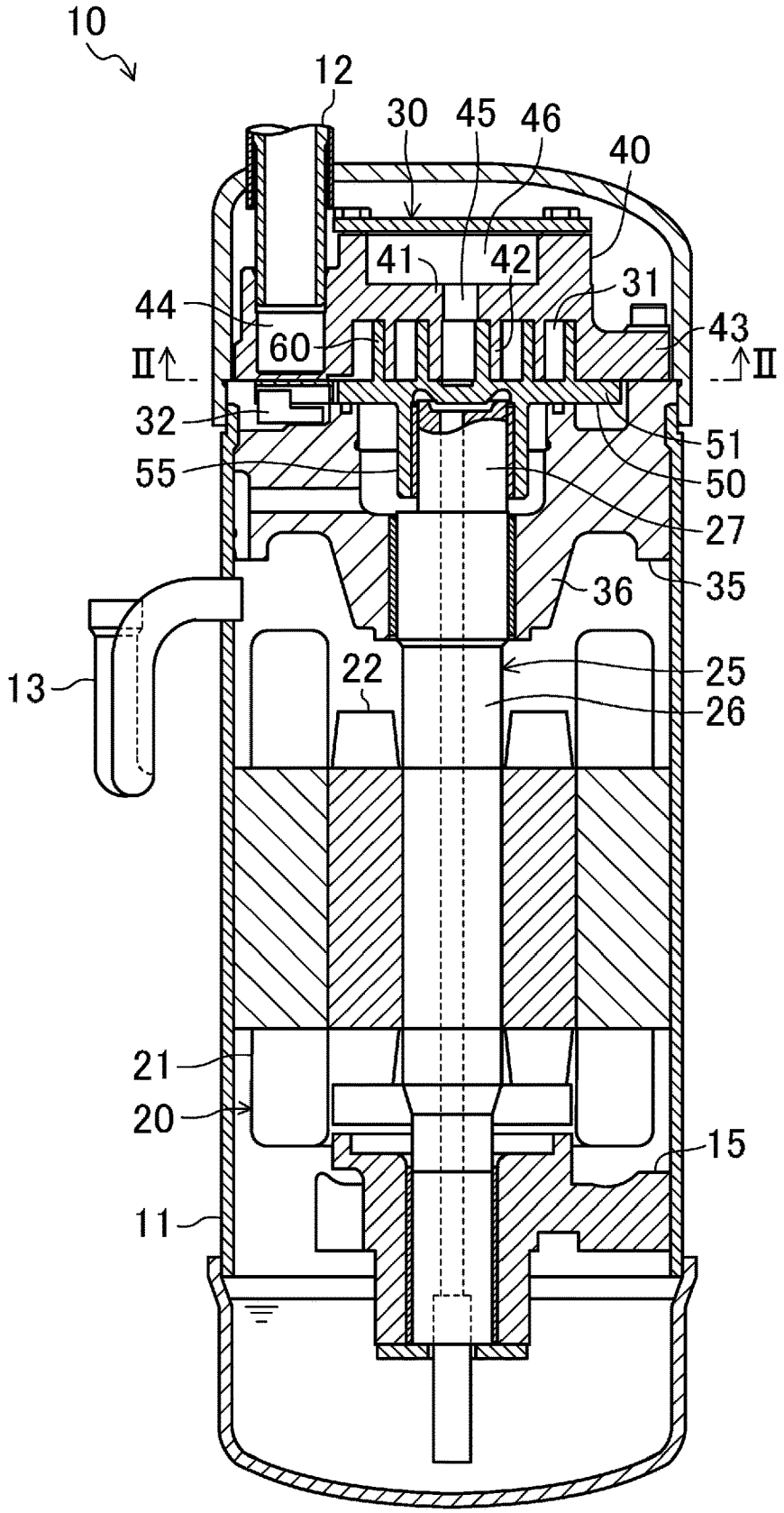
FIG. 1 is a vertical cross-sectional view of a scroll compressor according to an embodiment.

As shown in FIG. 1, the scroll compressor (10) is a hermetic compressor including a compression mechanism (30) and an electric motor (20) which are housed in a casing (11) which is a closed container.

The casing (11) is a cylindrical pressure vessel having closed ends. The casing (11) is placed so that its axial direction corresponds with a vertical direction. An upper end of the casing (11) is provided with a suction pipe (12) for introducing the refrigerant in the refrigerant circuit into the compression mechanism (30). The casing (11) is further provided with a discharge pipe (13) for discharging the refrigerant in the casing (11) out of the casing (11). A lubricant for lubricating the compression mechanism (30) and other components is stored in the bottom of the casing (11).

The electric motor (20) is arranged below the compression mechanism (30) in the casing (11). The electric motor (20) and the compression mechanism (30) are connected together by a drive shaft (25). The electric motor (20) includes a stator (21) and a rotor (22). The stator (21) of the electric motor (20) is fixed to the casing (11). The rotor (22) of the electric motor (20) is attached to the drive shaft (25).

The drive shaft (25) includes a main shaft portion (26) and an eccentric shaft portion (27). The main shaft portion (26) has an axial center that coincides with an axial center of the drive shaft (25). The rotor (22) of the electric motor (20) is attached to the main shaft portion (26). A bearing (36) of the compression mechanism (30), which will be described later, supports the main shaft portion (26) above the rotor (22), and a lower bearing member (15), which will be described later, supports the main shaft portion (26) below the rotor (22). The eccentric shaft portion (27) is in the shape of a relatively short shaft, and protrudes from an upper end of the main shaft portion (26). The eccentric shaft portion (27) has an axial center which is substantially parallel to the axial center of the main shaft portion (26), and is eccentric to the axial center of the main shaft portion (26).

A lower portion in the casing (11) is provided with a lower bearing member (15). The lower bearing member (15) is fixed to the casing (11). The lower bearing member (15)

constitutes a journal bearing that rotatably supports the main shaft portion (26) of the drive shaft (25).

Configuration of Compression Mechanism

The compression mechanism (30) includes a housing (35), a fixed scroll (40), an orbiting scroll (50), and an Oldham coupling (32). The housing (35) is fixed to the casing (11). The fixed scroll (40) is arranged on an upper surface of the housing (35). The orbiting scroll (50) is arranged between the fixed scroll (40) and the housing (35).

The housing (35) is a dish-shaped member which is recessed at a center portion thereof. In addition, a bearing (36) is formed in the housing (35). The bearing (36) is a thick cylindrical portion that protrudes downward. The bearing (36) constitutes a journal bearing that rotatably supports the main shaft portion (26) of the drive shaft (25).

Figure 2:
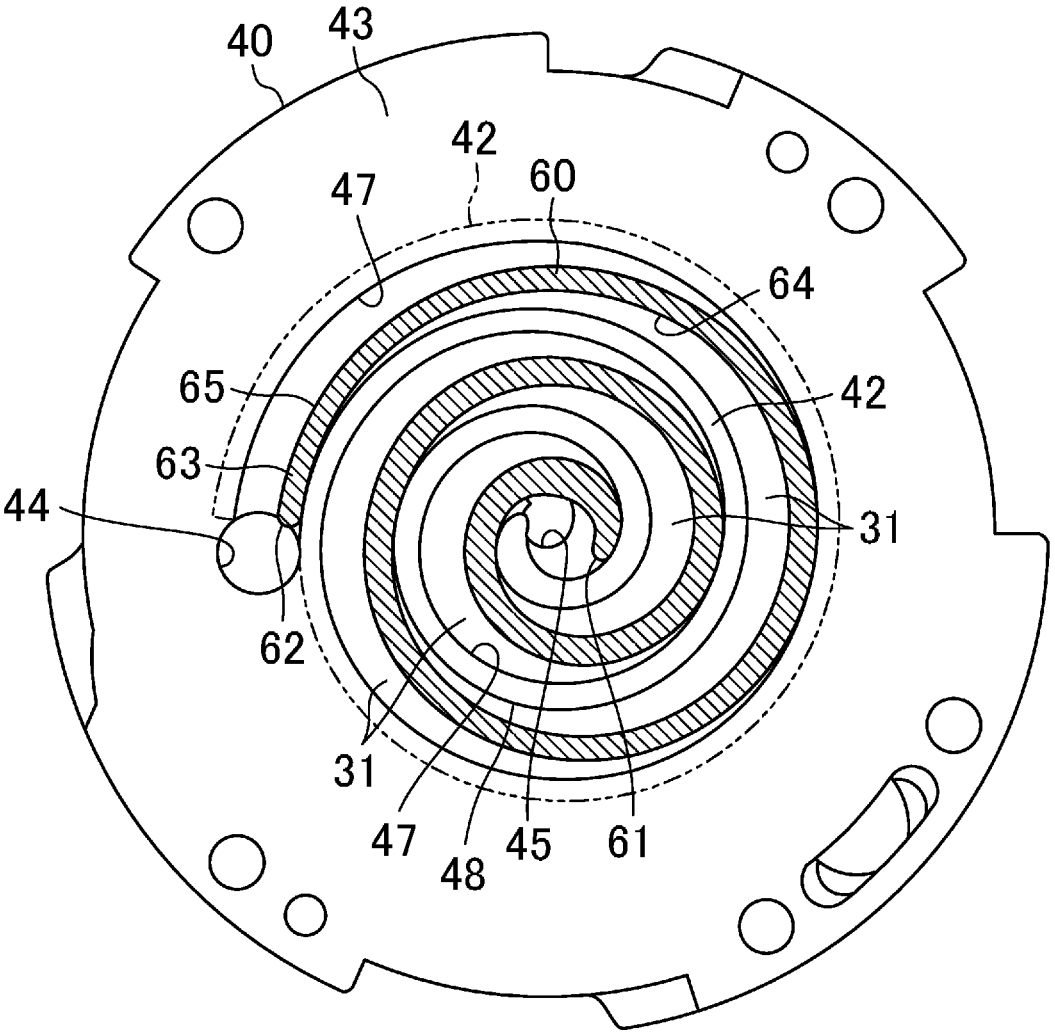
FIG. 2 is a cross-sectional view of a compression mechanism taken along line II-II shown in FIG. 1.

As also shown in FIG. 2, the fixed scroll (40) includes a fixed end plate (41), a fixed lap (42), and an outer peripheral wall portion (43). The fixed lap (42) is formed in a spiral wall-shape that draws an involute curve, and protrudes from a front surface (a lower surface in FIG. 1) of the fixed end plate (41). The outer peripheral wall portion (43) is formed to surround the outer periphery of the fixed lap (42), and protrudes from the front surface of the fixed end plate (41). An end face of the fixed lap (42) and an end face of the outer peripheral wall portion (43) are substantially flush with each other.

The compression mechanism (30) of the present embodiment is configured to have an asymmetric lap structure in which the fixed lap (42) is longer than an orbiting lap (60) of the orbiting scroll (50), which will be described later. As indicated by a phantom line in FIG. 2, an outermost portion of the fixed lap (42) is integrated with the outer peripheral wall portion (43).

Figure 3:
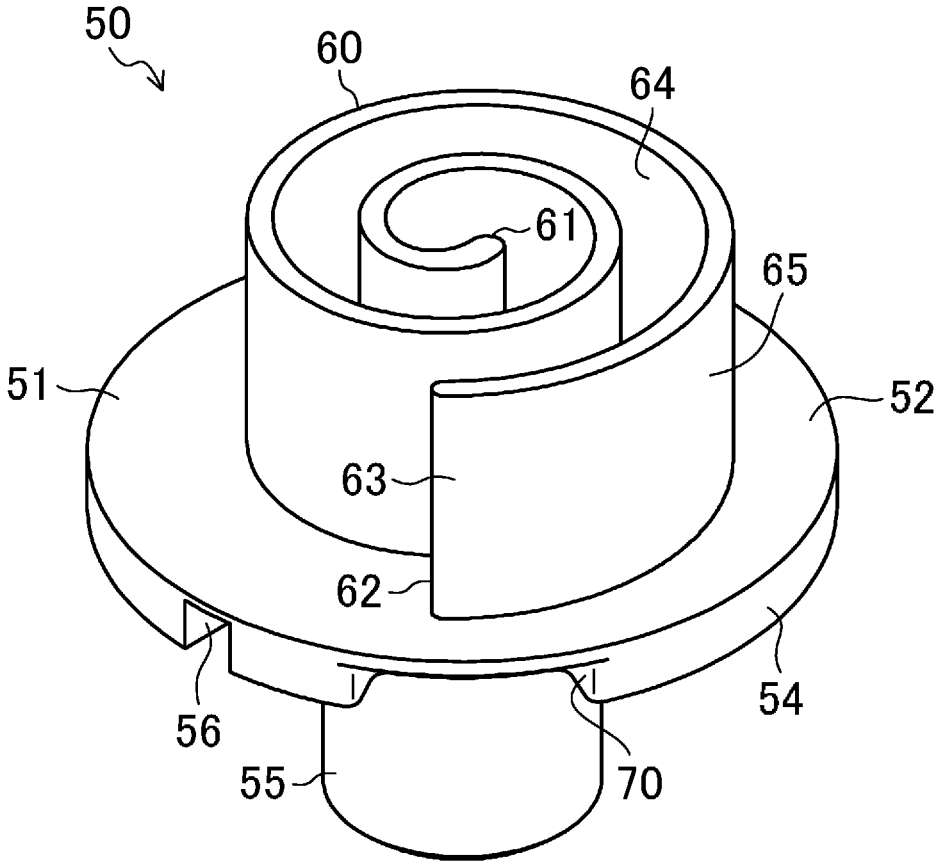
FIG. 3 is a perspective view of an orbiting scroll according to the embodiment as viewed from an orbiting lap.
Figure 4:
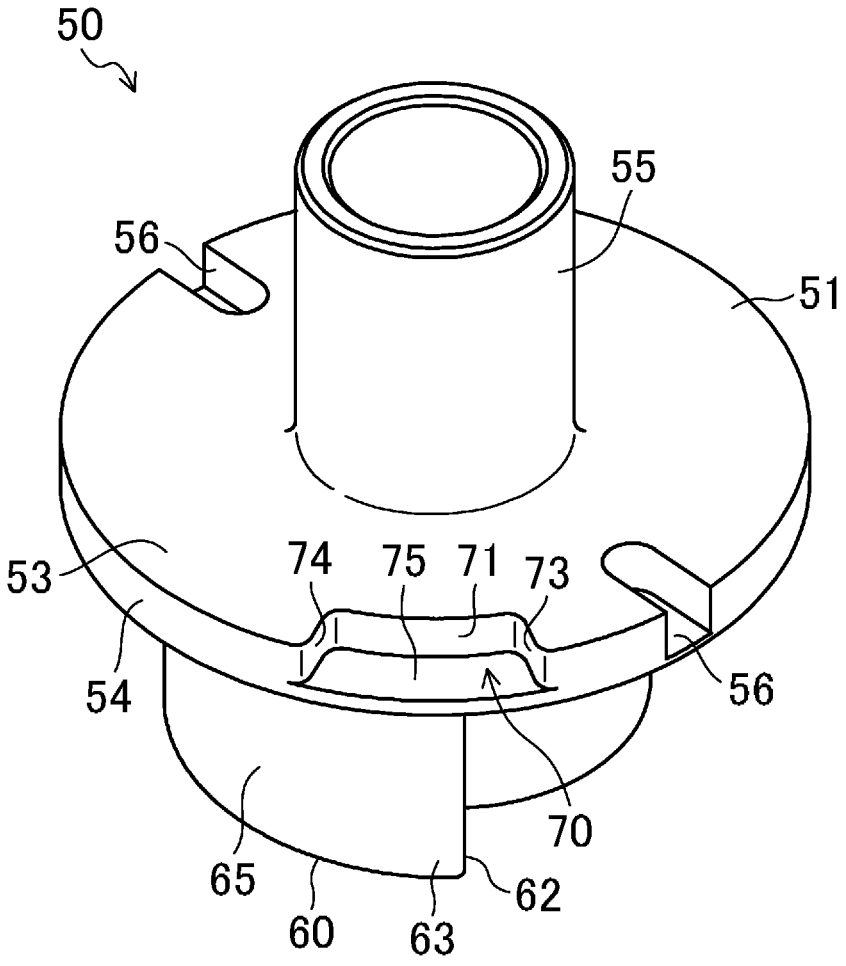
FIG. 4 is a perspective view of the orbiting scroll according to the embodiment as viewed from a boss.

As also shown in FIGS. 3 and 4, the orbiting scroll (50) includes an orbiting end plate (51), an orbiting lap (60), and a boss (55). The orbiting end plate (51) is in the shape of a generally round flat plate. The orbiting lap (60) is formed in a spiral wall-shape that draws an involute curve, and protrudes from a front surface (52) (an upper surface in FIG. 1) of the orbiting end plate (51). An end of the orbiting lap (60) near the center of the orbiting end plate (51) will be referred to as a winding start end (61), and the other end near an outer peripheral surface (54) of the orbiting end plate (51) will be referred to as a winding finish end (62). The boss (55) is formed in a cylindrical shape, and is arranged at a center portion of a rear surface (53) of the orbiting end plate (51). The eccentric shaft portion (27) of the drive shaft (25) is inserted into the boss (55).

Figure 5:
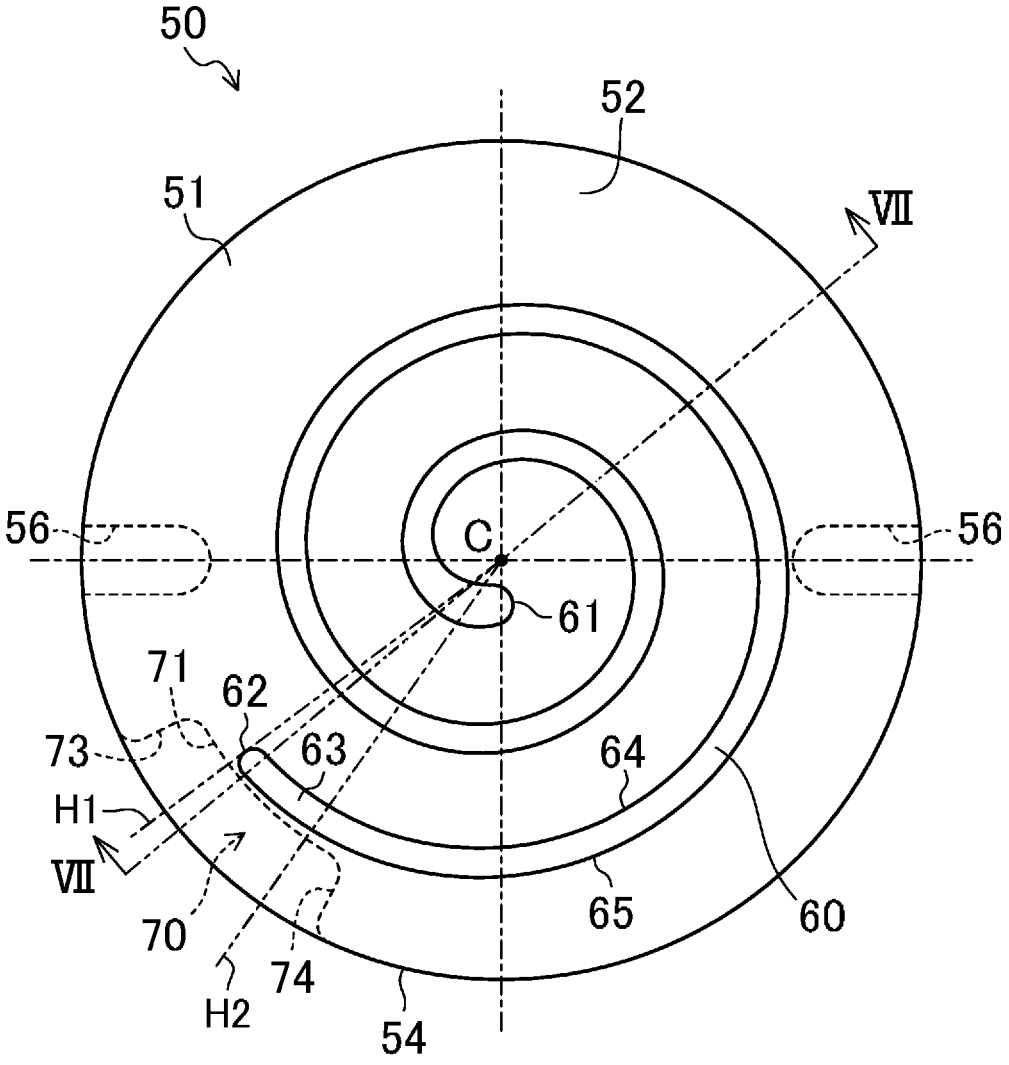
FIG. 5 is a plan view of the orbiting scroll according to the embodiment.
Figure 6:
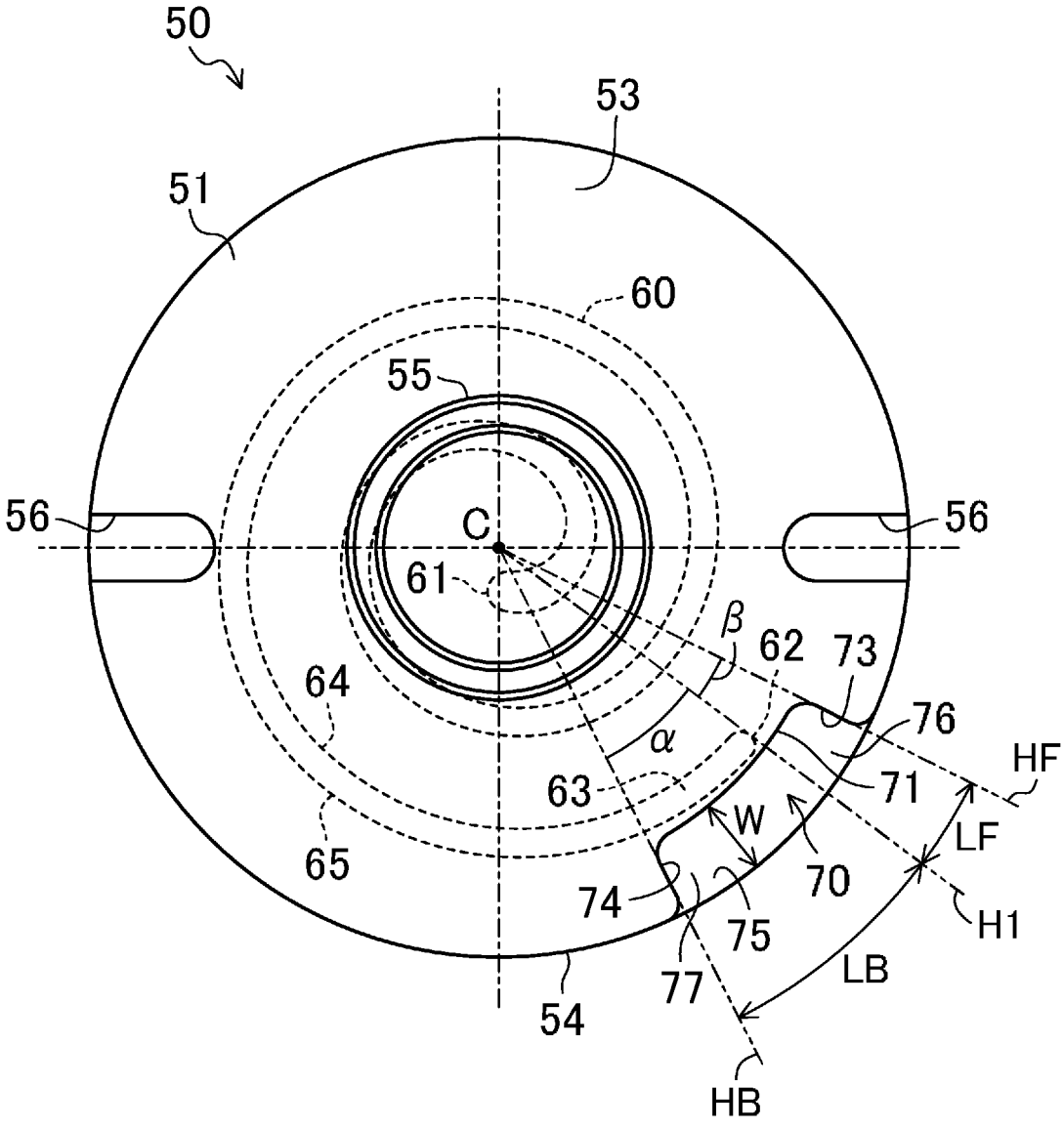
FIG. 6 is a rear view of the orbiting scroll according to the embodiment.
Figure 7:
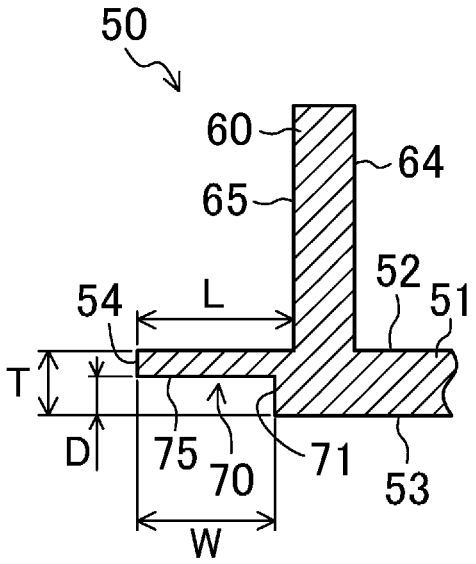
FIG. 7 is a cross-sectional view of a major part of the orbiting scroll taken along line VII-VII shown in FIG. 5.

The orbiting end plate (51) of the orbiting scroll (50) is provided with key grooves (56) and a rear concave portion (70). The key grooves (56) are recessed grooves that open in the rear surface (53) of the orbiting end plate. As shown in FIGS. 5 and 6, one key groove (56) is arranged to face another key groove (56) across the center of the orbiting end plate (51). Keys of the Oldham coupling (32) fit into the key grooves (56). The rear concave portion (70) will be described later.

The Oldham coupling (32) is arranged between the orbiting scroll (50) and the housing (35). The Oldham coupling (32) engages with the orbiting scroll (50) and the housing (35), and regulates the rotation of the orbiting scroll (50).

As also shown in FIG. 2, the orbiting lap (60) of the orbiting scroll (50) meshes with the fixed lap (42) of the fixed scroll (40). An inner surface (64) of the orbiting lap (60) slides on an outer surface (48) of the fixed lap (42), and an outer surface (65) of the orbiting lap (60) slides on an inner surface (47) of the fixed lap (42). The inner surface (64) of the orbiting lap (60) is one of sidewall surfaces of the orbiting lap (60) that slides on the outer surface (48) of the fixed lap (42). The outer surface (65) of the orbiting lap (60) is the other sidewall surface of the orbiting lap (60) that slides on the inner surface (47) of the fixed lap (42). The compression mechanism (30) forms the compression chamber (31) surrounded by the fixed end plate (41) and fixed lap (42) of the fixed scroll (40) and the orbiting end plate (51) and orbiting lap (60) of the orbiting scroll (50).

A suction port (44) is formed in the outer peripheral wall portion (43) of the fixed scroll (40). A downstream end of the suction pipe (12) is connected to the suction port (44). A discharge port (45) penetrating the fixed end plate (41) is formed in the center of the fixed end plate (41) of the fixed scroll (40).

A high pressure chamber (46) is formed in the center of a rear surface (an upper surface in FIG. 1) of the fixed end plate (41). The high pressure chamber (46) is a space communicating with the discharge port (45). The high pressure chamber (46) communicates with a space in the casing (11) below the housing (35) via a passage (not shown).

Operation of Scroll Compressor

In the scroll compressor (10), the orbiting scroll (50) of the compression mechanism (30) is driven by the electric motor (20) to revolve. The orbiting scroll (50) of the present embodiment revolves in a clockwise direction in FIG. 2. When the orbiting scroll (50) moves, the refrigerant that has flowed into the suction port (44) from the suction pipe (12) flows into the compression chamber (31). As the orbiting scroll (50) moves, the compression chamber (31) moves from the winding finish end (62) of the orbiting lap (60) to the winding start end (61) of the orbiting lap (60), and accordingly, the volume of the compression chamber (31) decreases to compress the refrigerant in the compression chamber (31). The compressed refrigerant is discharged from the compression chamber (31) into the high pressure chamber (46) through the discharge port (45). The refrigerant that has flowed into the high pressure chamber (46) flows into the space below the housing (35) in the casing (11), and then flows out of the casing (11) through the discharge pipe (13).

Rear Concave Portion of Orbiting End Plate

As described above, the orbiting end plate (51) of the orbiting scroll (50) is provided with the rear concave portion (70). The rear concave portion (70) will be described in detail with reference to FIGS. 3 to 7.

The rear concave portion (70) is a concave portion that opens in both of the rear surface (53) and outer peripheral surface (54) of the orbiting end plate (51). The rear concave portion (70) is curved along an outer peripheral edge of the orbiting end plate (51). Specifically, the rear concave portion (70) extends along a winding finish portion (63) of the orbiting lap (60) (see FIGS. 5 and 6). The winding finish portion (63) of the orbiting lap (60) will be described later.

An inner peripheral wall surface (71) of the rear concave portion (70) is a portion of a sidewall surface of the rear concave portion (70) extending along the winding finish portion (63) of the orbiting lap (60). The inner peripheral wall surface (71) is located slightly outside of the outer surface (65) of the winding finish portion (63) of the orbiting lap (60) in a radial direction of the orbiting end plate (51) (see FIGS. 5 to 7). Specifically, the whole rear concave portion (70) is located outside the winding finish portion (63) of the orbiting lap (60) in the radial direction of the orbiting end plate (51).

The rear concave portion (70) spreads over a front side and rear side of the winding finish end (62) of the orbiting lap (60) in a circumferential direction of the orbiting end plate (51). Specifically, suppose that an angle around a center C of the orbiting end plate (51) is a central angle, the rear concave portion (70) is formed in a region of the orbiting end plate (51) of the present embodiment having the central angle within a predetermined numerical range and including the winding finish end (62) of the orbiting lap (60). Note that the center C of the orbiting end plate (51) is a point on the center axis of the boss (55). In other words, the rear concave portion (70) spreads over the front and rear sides of the winding finish end (62) of the orbiting lap (60) in an extending direction of the orbiting lap (60). The extending direction of the orbiting lap (60) is a direction from the winding start end (61) of the orbiting lap (60) to the winding finish end (62) of the orbiting lap (60) along the orbiting lap (60).

A front wall surface (73) of the rear concave portion (70) is a plane partially including a half line HF shown in FIG. 6. The half line HF extends outward from the center C of the orbiting end plate (51) in the radial direction of the orbiting end plate (51). The front wall surface (73) of the rear concave portion (70) is located in front of the winding finish end (62) of the orbiting lap (60) in the circumferential direction of the orbiting end plate (51) (advanced in the clockwise direction in FIG. 5, or the counterclockwise direction in FIG. 6). Specifically, the front wall surface (73) of the rear concave portion (70) is arranged at a position forward of the winding finish end (62) of the orbiting lap (60) in a winding direction of the orbiting lap (60). The winding direction of the orbiting lap (60) is the same as the extending direction of the orbiting lap (60) described above.

A rear wall surface (74) of the rear concave portion (70) is a plane partially including a half line HB shown in FIG. 6. The half line HB extends outward from the center C of the orbiting end plate (51) in the radial direction of the orbiting end plate (51). The rear wall surface (74) of the rear concave portion (70) is located behind the winding finish end (62) of the orbiting lap (60) in the circumferential direction of the orbiting end plate (51) (advanced in the counterclockwise direction in FIG. 5, or the clockwise direction in FIG. 6). Specifically, the rear wall surface (74) of the rear concave portion (70) is arranged at a position closer to the winding start end (61) of the orbiting lap (60) than the winding finish end (62) in the winding direction of the orbiting lap (60). The winding direction of the orbiting lap (60) is the same as the extending direction of the orbiting lap (60) described above.

In the orbiting end plate (51) of the present embodiment, an angle $\alpha$ formed by a half line H1 and the half line HB is equal to or greater than an angle $\beta$ formed by the half line H1 and the half line HF ($\alpha \geq \beta$). In the present embodiment, the angle $\alpha$ is 35°, and the angle $\beta$ is 15°. The angle $\alpha$ is desirably equal to or greater than twice the angle $\beta$ ($\alpha \geq 2\beta$). Note that the half line H1 extends outward from the center C of the orbiting end plate (51) in the radial direction of the orbiting end plate (51) and passing through the winding finish end (62) of the orbiting lap (60).

A portion of the rear concave portion (70) spreading forward of the winding finish end (62) of the orbiting lap (60) in the circumferential direction of the orbiting end plate (51) is referred to as a front portion (76), and a portion spreading rearward of the winding finish end (62) of the orbiting lap (60) in the circumferential direction of the orbiting end plate (51) is referred to as a rear portion (77). The front portion (76) is a second portion of the rear concave portion (70) spreading forward of the winding finish end (62) of the orbiting lap (60) in the extending direction of the orbiting lap (60). The rear portion (77) is a first portion of the rear concave portion (70) spreading rearward of the winding finish end (62) of the orbiting lap (60) in the extending direction of the orbiting lap (60).

In the rear concave portion (70), a length LF of the front portion (76) in the circumferential direction of the orbiting end plate (51) is proportional to the angle $\beta$, and a length LB of the rear portion (77) in the circumferential direction of the orbiting end plate (51) to the angle $\alpha$. As described above, the rear concave portion (70) of the present embodiment has the angle $\alpha$ which is equal to or greater than the angle $\beta$. Therefore, in the rear concave portion (70) of the present embodiment, the length LB of the rear portion (77) in the circumferential direction of the orbiting end plate (51) is equal to or greater than the length LF of the front portion (76) in the circumferential direction of the orbiting end plate (51) ($LB \geq LF$).

The rear concave portion (70) has a substantially constant width W in the radial direction of the orbiting end plate (51) over the whole length thereof in the circumferential direction of the orbiting end plate (51). In the present embodiment, the width W of the rear concave portion (70) is a distance from the inner peripheral wall surface of the rear concave portion (70) to the outer peripheral surface (54) of the orbiting end plate (51). Here, the distance from the outer surface (65) of the orbiting lap (60) to the outer peripheral surface (54) of the orbiting end plate (51) is referred to as L (see FIG. 7). In the present embodiment, the width W of the rear concave portion (70) is greater than half the minimum value Lmin of the distance L ($W > Lmin/2$).

In the present embodiment, the rear concave portion (70) has a depth D of about 62% of a thickness T of the orbiting end plate (51). The depth D of the rear concave portion (70) of the present embodiment is substantially constant over the whole rear concave portion (70). Accordingly, a bottom surface (75) of the rear concave portion (70) is a flat surface that is substantially parallel to the front surface (52) of the orbiting end plate (51). The depth D of the rear concave portion (70) is desirably equal to or greater than half the thickness T of the orbiting end plate (51) ($D \geq T/2$). Further, the depth D of the rear concave portion (70) is equal to or greater than 0.5 T and equal to or smaller than 0.8 T. Specifically, in the present embodiment, the depth D of the rear concave portion (70) and the thickness T of the orbiting end plate (51) desirably satisfy $0.5 \leq D/T \leq 0.8$.

Here, the winding finish portion (63) of the orbiting lap (60) is a portion near the winding finish end (62) of the orbiting lap (60). In the present embodiment, the winding finish portion (63) of the orbiting lap (60) refers to a portion of the orbiting lap (60) between the half line H1 and a half line H2 in FIG. 5. The half line H2 extends outward from the center C of the orbiting end plate (51) in the radial direction of the orbiting end plate (51), and forms an angle of 20° with a straight line L1. As described above, the winding finish portion (63) of the orbiting lap (60) of the present embodiment is a portion of the orbiting lap (60) forming the angle around the center C of the orbiting end plate (central angle) of 20° from the winding finish end (62) of the orbiting lap (60). The value (20°) of the central angle shown here is merely an example.

Load Acting on Orbiting Lap

While the scroll compressor (10) is in operation, the pressure of the refrigerant in the compression chamber (31) acts on each of the inner surface (64) and outer surface (65) of the orbiting lap (60) of the orbiting scroll (50). The greater the difference between the force acting on the inner surface (64) of the orbiting lap (60) and the force acting on the outer surface (65) is, the greater load acts on the orbiting lap (60).

As shown in FIG. 2, the winding finish portion (63) of the orbiting lap (60) is located near the suction port (44) of the compression mechanism (30). Thus, while the scroll compressor (10) is in operation, the pressure of the refrigerant acting on each of the inner surface (64) and outer surface (65) of the winding finish portion (63) of the orbiting lap (60) is substantially equal to the pressure of the refrigerant sucked into the compression chamber (31) through the suction port (44). Therefore, during the operation of the scroll compressor (10), a load acting on the winding finish portion (63) of the orbiting lap (60) is not so large.

Just after the stop of the scroll compressor (10) (i.e., just after the energization of the electric motor (20) is blocked), the refrigerant flows back from the discharge port (45) to the compression chamber (31) and expands in the compression chamber (31). This may cause the orbiting scroll (50) to turn in the reverse direction (counterclockwise in FIG. 2 in this embodiment). Further, during the reverse rotation of the orbiting scroll (50), even when the compression chamber (31) has reached the winding finish portion (63) of the orbiting lap (60), the pressure of the refrigerant in the compression chamber (31) may fail to be lowered to the pressure of the refrigerant at the suction port (44). In this case, the difference between fluid pressures acting on the inner surface (64) and outer surface (65) of the winding finish portion (63) of the orbiting lap (60) is larger than the difference caused during the operation of the scroll compressor (10).

As described above, during the reverse rotation of the orbiting scroll (50), the load acting on the winding finish portion (63) of the orbiting lap (60) may become larger than the load acting on the same during the forward rotation of the orbiting scroll (50). If a relatively large load acts on the winding finish portion (63) of the orbiting lap (60) in the case where a portion of the orbiting end plate (51) near the winding finish portion (63) of the orbiting lap (60) is approximately as thick as the other portion, the orbiting end plate (51) is hardly elastically deformed, and a stress concentrates on the vicinity of a root (a base end portion closer to the orbiting end plate (51)) of the winding finish portion (63) of the orbiting lap (60). This may lead to the break of the orbiting lap (60).

On the other hand, in the scroll compressor (10) of the present embodiment, the rear concave portion (70) is formed in the orbiting end plate (51) of the orbiting scroll (50). As mentioned above, the rear concave portion (70) extends along the winding finish portion (63) of the orbiting lap (60). Thus, the orbiting end plate (51) has a portion which is relatively thin and less rigid near the winding finish portion (63) of the orbiting lap (60). Therefore, a portion of the orbiting end plate (51) of the present embodiment extending along the winding finish portion (63) of the orbiting lap (60) has a relatively low rigidity.

When a relatively large load acts on the winding finish portion (63) of the orbiting lap (60) during the reverse rotation of the orbiting scroll (50), the winding finish portion (63) of the orbiting lap (60) is elastically deformed, and in addition, the portion of the orbiting end plate (51) near the winding finish portion (63) of the orbiting lap (60) is also elastically deformed. Therefore, the stress exerted on the winding finish portion (63) of the orbiting lap (60) during the reverse rotation of the orbiting scroll (50) is dispersed, and the stress exerted near the root of the winding finish portion (63) of the orbiting lap (60) is reduced. In the present embodiment, the stress exerted near the root of the winding finish portion (63) of the orbiting lap (60) during the reverse rotation of the orbiting scroll (50) decreases to about 84% of the stress caused in the case where the orbiting end plate (51) has no rear concave portion (70).

First Embodiment

The scroll compressor (10) of the present embodiment includes: the orbiting scroll (50) having the disk-shaped orbiting end plate (51) and the spiral wall-shaped orbiting lap (60) protruding from the front surface (52) of the orbiting end plate (51); and the fixed scroll (40) having the spiral wall-shaped fixed lap (42) meshing with the orbiting lap (50). In the scroll compressor (10), the orbiting end plate (51) is provided with the rear concave portion (70) which opens in the rear surface (53) of the orbiting end plate (51) and extends along the winding finish portion (63) of the orbiting lap (60).

The portion of the orbiting end plate (51) of the present embodiment where the rear concave portion (70) is formed is thinner than the other portion, and thus, is less rigid than the other portion. The rear concave portion (70) extends along the winding finish portion (63) of the orbiting lap (60). Therefore, the orbiting end plate (51) becomes relatively less rigid in the portion extending along the winding finish portion (63) of the orbiting lap (60).

During the reverse rotation of the orbiting scroll (50), a relatively large stress may be exerted on the winding finish portion (63) of the orbiting lap (60). In this case, in the scroll compressor (10) of the present embodiment, the portion of the orbiting end plate (51) where the rear concave portion (70) is formed (i.e., the relatively less rigid portion) is elastically deformed. This reduces a stress exerted on a root portion (i.e., a base end portion closer to the orbiting end plate (51)) of the winding finish portion (63) of the orbiting lap (60), and the damage to the orbiting lap (60) is avoided.

Second Embodiment

In the scroll compressor (10) of the present embodiment, the rear concave portion (70) spreads over the front and rear sides of the winding finish end (62) of the orbiting lap (60) in an extending direction of the orbiting lap (60). The extending direction of the orbiting lap (60) is a direction from the winding start end (61) of the orbiting lap (60) to the winding finish end (62) of the orbiting lap (60) along the orbiting lap (60).

The rear concave portion (70) of the present embodiment has a portion spreading forward of the winding finish end (62) of the orbiting lap (60) in the extending direction of the orbiting lap (60), and the remaining portion spreading rearward of the winding finish end (62) of the orbiting lap (60) in the extending direction of the orbiting lap (60).

Further, in the scroll compressor (10) of the present embodiment, the rear concave portion (70) spreads over the front and rear sides of the winding finish end (62) of the orbiting lap (60) in the circumferential direction of the orbiting end plate (51).

The rear concave portion (70) of the present embodiment has a portion spreading forward of the winding finish end (62) of the orbiting lap (60) in the circumferential direction of the orbiting end plate (51), and the remaining portion spreading rearward of the winding finish end (62) of the orbiting lap (60) in the circumferential direction of the orbiting end plate (51).

Third Embodiment

In the scroll compressor (10) of the present embodiment, the rear concave portion (70) has the "rear portion (77) spreading rearward of the winding finish end (62) of the orbiting lap (60) in the extending direction of the orbiting lap (60)," and the "front portion (76) spreading forward of the winding finish end (62) of the orbiting lap (60) in the extending direction of the orbiting lap (60)," the rear portion (77) having a length equal to or greater than the front portion (76) in the circumferential direction of the orbiting end plate (51).

In the rear concave portion (70) of the present embodiment, the portion (77) spreading rearward of the winding finish end (62) of the orbiting lap (60) in the extending direction of the orbiting lap (60) extends along the winding finish portion (63) of the orbiting lap (60), and the portion (76) spreading forward of the winding finish end (62) of the orbiting lap (60) in the extending direction of the orbiting lap (60) is separated from the winding finish portion (63) of the orbiting lap (60). Therefore, in the rear concave portion (70) of this configuration, the portion (77) extending along the winding finish portion (63) of the orbiting lap (60) has a length equal to or greater than the portion (76) separated from the winding finish portion (63) of the orbiting lap (60).

In the scroll compressor (10) of the present embodiment, the rear concave portion (70) has the "rear portion (77) spreading rearward of the winding finish end (62) of the orbiting lap (60) in the circumferential direction of the orbiting end plate (51)," and the "front portion (76) spreading forward of the winding finish end (62) of the orbiting lap (60) in the circumferential direction of the orbiting end plate (51)," the rear portion (77) having a length equal to or greater than the front portion (76) in the circumferential direction of the orbiting end plate (51).

In the rear concave portion (70) of the present embodiment, the portion (77) spreading rearward of the winding finish end (62) of the orbiting lap (60) in the circumferential direction of the orbiting end plate (51) extends along the winding finish portion (63) of the orbiting lap (60), and the portion (76) spreading forward of the winding finish end (62) of the orbiting lap (60) in the circumferential direction of the orbiting end plate (51) is separated from the winding finish portion (63) of the orbiting lap (60). Therefore, in the rear concave portion (70) of this embodiment, the portion (77) extending along the winding finish portion (63) of the orbiting lap (60) has a length equal to or greater than the portion (76) separated from the winding finish portion (63) of the orbiting lap (60).

Fourth Embodiment

In the scroll compressor (10) of the present embodiment, the rear concave portion (70) opens in both of the rear surface (53) and outer peripheral surface (54) of the orbiting end plate (51).

In the orbiting end plate (51) of the present embodiment, the rear concave portion (70) opens in both of the rear surface (53) and outer peripheral surface (54) of the orbiting end plate (51). The outer peripheral surface (54) of the orbiting end plate (51) is located outside the orbiting lap (60) in the radial direction of the orbiting end plate (51). Therefore, the rear concave portion (70) of the present embodiment at least partially spreads outward of the winding finish portion (63) of the orbiting lap (60) in the radial direction of the orbiting end plate (51). In the orbiting end plate (51) of the present embodiment, the rear concave portion (70) opens in the outer peripheral surface (54), which lowers the rigidity of the portion of the orbiting end plate (51) extending along the winding finish portion (63) of the orbiting lap (60).

Fifth Embodiment

In the scroll compressor (10) of the present embodiment, the whole rear concave portion (70) is formed outside the orbiting lap (60) in the radial direction of the orbiting end plate (51).

In the present embodiment, the whole rear concave portion (70) is arranged in a portion of the orbiting end plate (51) outside the orbiting lap (60) in the radial direction of the orbiting end plate (51).

Sixth Embodiment

The scroll compressor (10) of the present embodiment satisfies $0.5 \leq D/T \leq 0.8$, where D represents the depth of the rear concave portion (70), and T the thickness of the orbiting end plate (51).

Therefore, the portion of the orbiting end plate (51) where the rear concave portion (70) is formed becomes relatively less rigid, which reduces the stress exerted on the root portion of the winding finish portion (63) of the orbiting lap (60).

Other Embodiments

The foregoing embodiment may be modified as follows.

First Variation

In the orbiting scroll (50) of the present embodiment, the rear concave portion (70) of the orbiting end plate (51) may spread over the inner side and outer side of the outer surface (65) of the winding finish portion (63) of the orbiting lap (60) in the radial direction of the orbiting end plate (51). That is, in the orbiting scroll (50) of the present embodiment, the rear concave portion (70) of the orbiting end plate (51) only may at least partially spread outward of the winding finish portion (63) of the orbiting lap (60) in the radial direction of the orbiting end plate (51).

Figure 8:
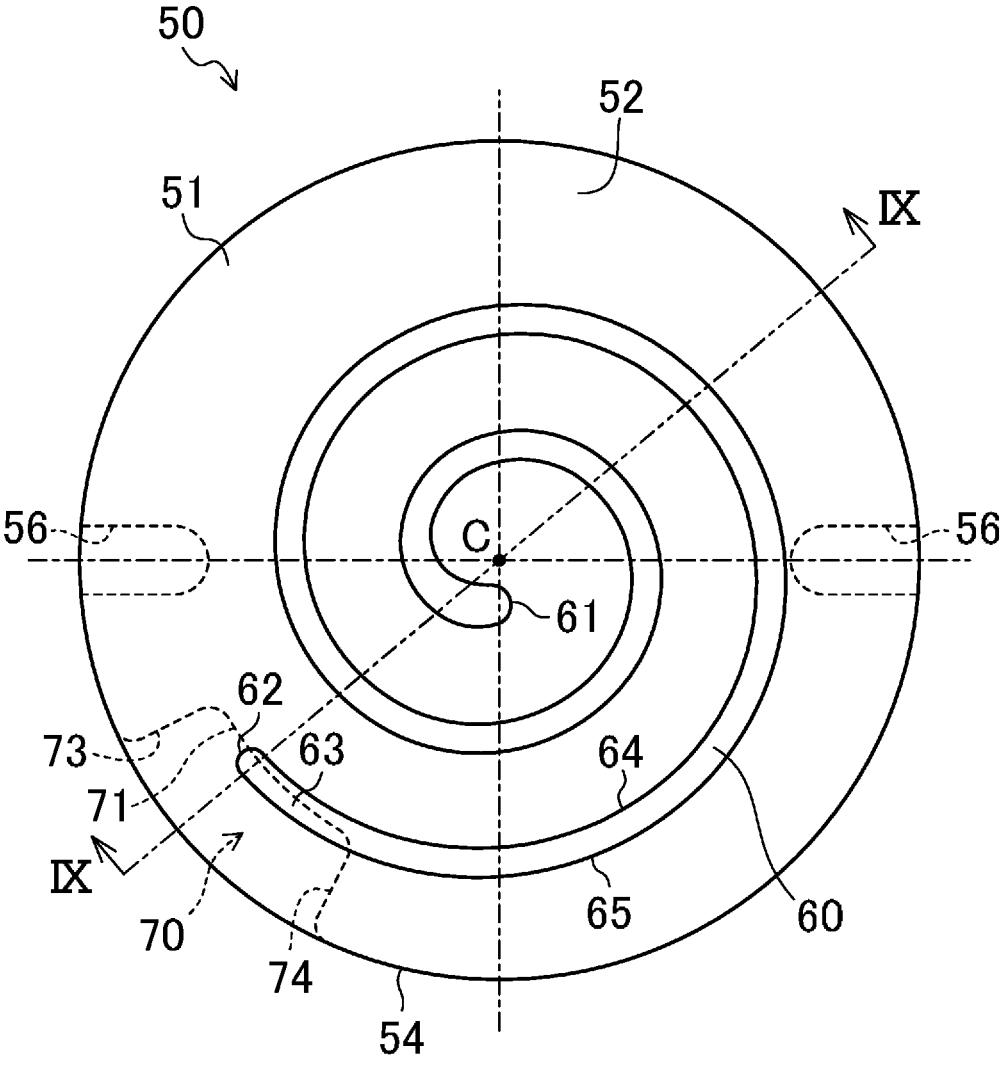
FIG. 8 is a plan view of an orbiting scroll according to a first variation.
Figure 9:
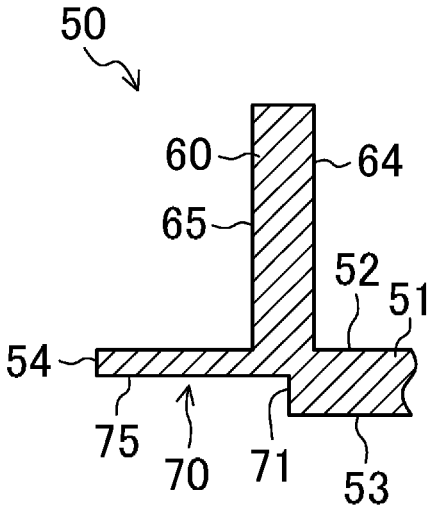
FIG. 9 is a cross-sectional view of a major part of the orbiting scroll taken along line IX-IX shown in FIG. 8.
Figure 10:
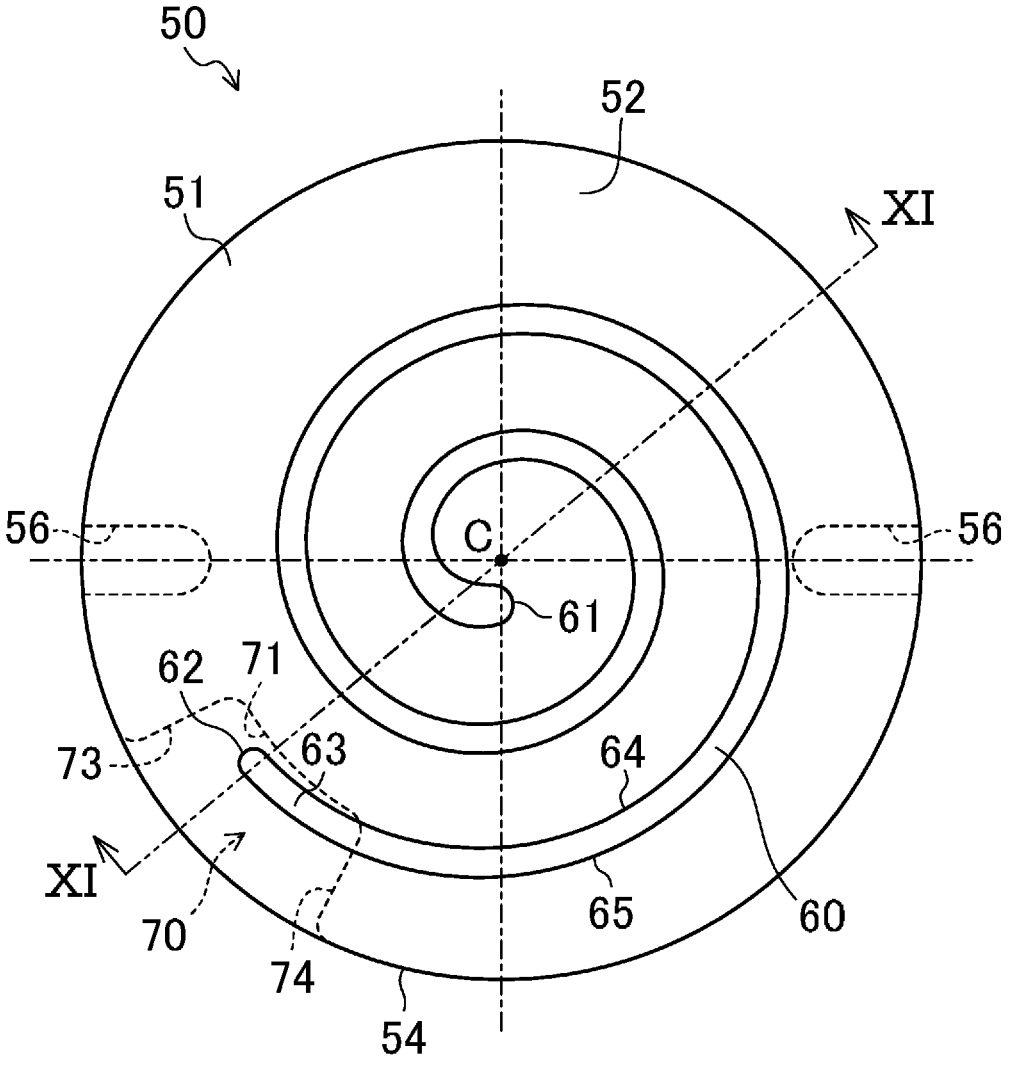
FIG. 10 is a plan view of the orbiting scroll according to the first variation.
Figure 11:
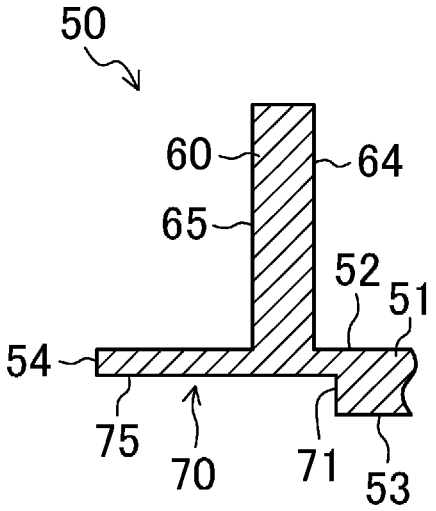
FIG. 11 is a cross-sectional view of a major part of the orbiting scroll taken along line XI-XI shown in FIG. 10.

In the orbiting scroll (50) of this variation shown in FIGS. 8 and 9, the inner peripheral wall surface (71) of the rear concave portion (70) is located between the inner surface (64) and outer surface (65) of the winding finish portion (63) of the orbiting lap (60) in the radial direction of the orbiting end plate (51). Further, FIGS. 10 and 11 show the orbiting scroll (50) of this variation, in which the inner peripheral wall surface (71) of the rear concave portion (70) is located inside the inner surface (64) of the winding finish portion (63) of the orbiting lap (60) in the radial direction of the orbiting end plate (51).

In the scroll compressor (10) of this variation, the rear concave portion (70) spreads over the inner side and outer side of the outer surface (65) of the winding finish portion (63) of the orbiting lap (60) in the radial direction of the orbiting end plate (51).

In the orbiting end plate (51) of this variation, the rear concave portion (70) spreads over a portion of the orbiting end plate (51) outside the orbiting lap (60) in the radial direction of the orbiting end plate (51) and a portion of the orbiting end plate (51) inside the outer peripheral surface (65) of the winding finish portion (63) of the orbiting lap (60) in the radial direction of the orbiting end plate (51). Therefore, the portion of the orbiting end plate (51) near the winding finish portion (63) of the orbiting lap (60) reliably becomes less rigid, which alleviates the concentration of stress on the base end portion of the winding finish portion (63) of the orbiting lap (60).

Figure 12:
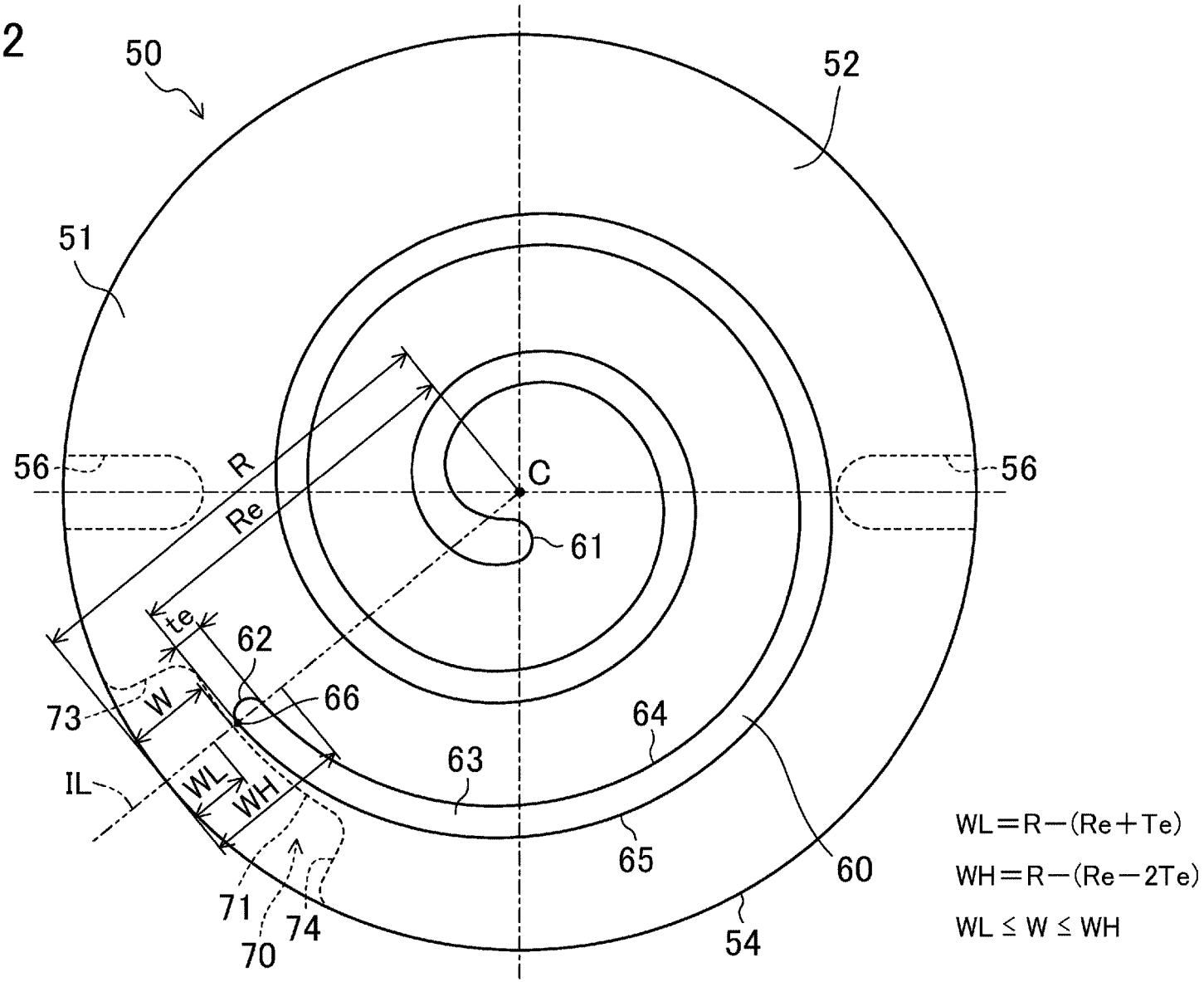
FIG. 12 is a plan view of the orbiting scroll according to the first variation.

As shown in FIG. 12, in the scroll compressor (10) according to the present embodiment and the present variation, the width W of the rear concave portion (70) is desirably in a range of WL or more and WH or less (WL≤W≤WH). WL and WH are values expressed by the following equations.

$$WL=R-(Re+te)$$

$$WH=R-(Re-2te)$$

Values "R", "Re", and "te" in the above equations will be described with reference to FIG. 12. A straight line passing through an outermost peripheral end (66) of the outer surface (65) of the orbiting lap (60) and the center (C) of the orbiting end plate (51) is defined as a straight line IL. "R" represents a distance from the center C of the orbiting end plate (51) to the outer peripheral surface (54) of the orbiting end plate (51) on the straight line IL. "Re" represents a distance from the center C of the orbiting end plate (51) to the outer surface (65) of the orbiting lap (60) on the straight line IL. "te" represents the thickness of the orbiting lap (60) on the straight line IL.

When WL≤W≤WH is satisfied, the inner peripheral wall surface (71) of the rear concave portion (70) is positioned near the winding finish portion (63) of the orbiting lap (60). Thus, provision of the rear concave portion (70) can reliably reduce the rigidity of a region of the orbiting end plate (51) near the winding finish portion (63) of the orbiting lap (60). Therefore, in this case, the stress exerted on the root portion of the winding finish portion (63) of the orbiting lap (60) can be reduced, and damage to the orbiting lap (60) can be avoided.

Second Variation

Figure 13:
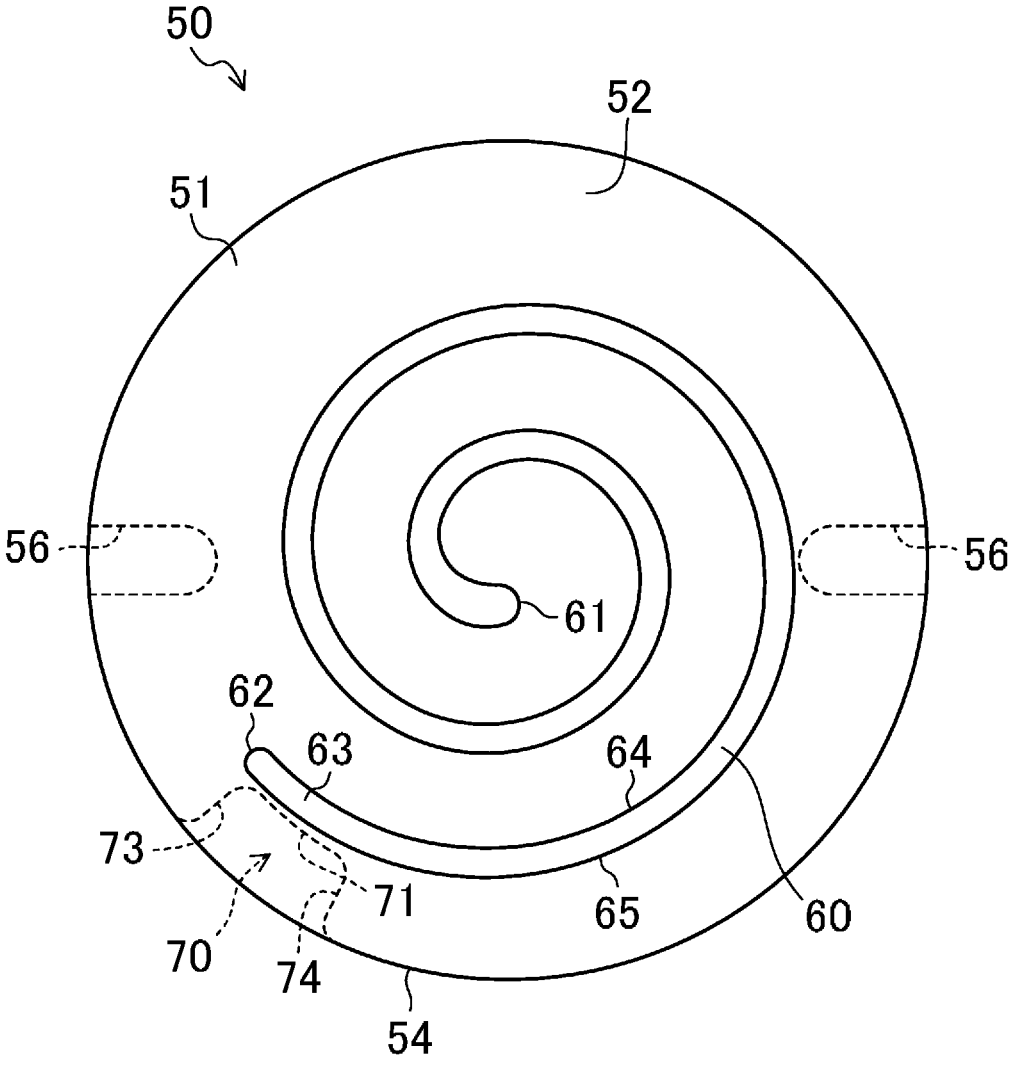
FIG. 13 is a plan view of an orbiting scroll according to a second variation.

As shown in FIG. 13, in the orbiting scroll (50) of the present embodiment, the whole rear concave portion (70) of the orbiting end plate (51) may extend along the winding finish portion (63) of the orbiting lap (60).

The front wall surface (73) of the rear concave portion (70) of this variation is located behind the winding finish end (62) of the orbiting lap (60) in the circumferential direction of the orbiting end plate (51). In other words, the front wall surface (73) of the rear concave portion (70) of this variation is located behind the winding finish end (62) of the orbiting lap (60) in the extending direction of the orbiting lap (60). Therefore, in this variation, the whole rear concave portion (70) is located behind the winding finish end (62) of the orbiting lap (60) in the circumferential direction of the orbiting end plate (51). In other words, in this variation, the whole rear concave portion (70) is located behind the winding finish end (62) of the orbiting lap (60) in the extending direction of the orbiting lap (60).

Figure 14:
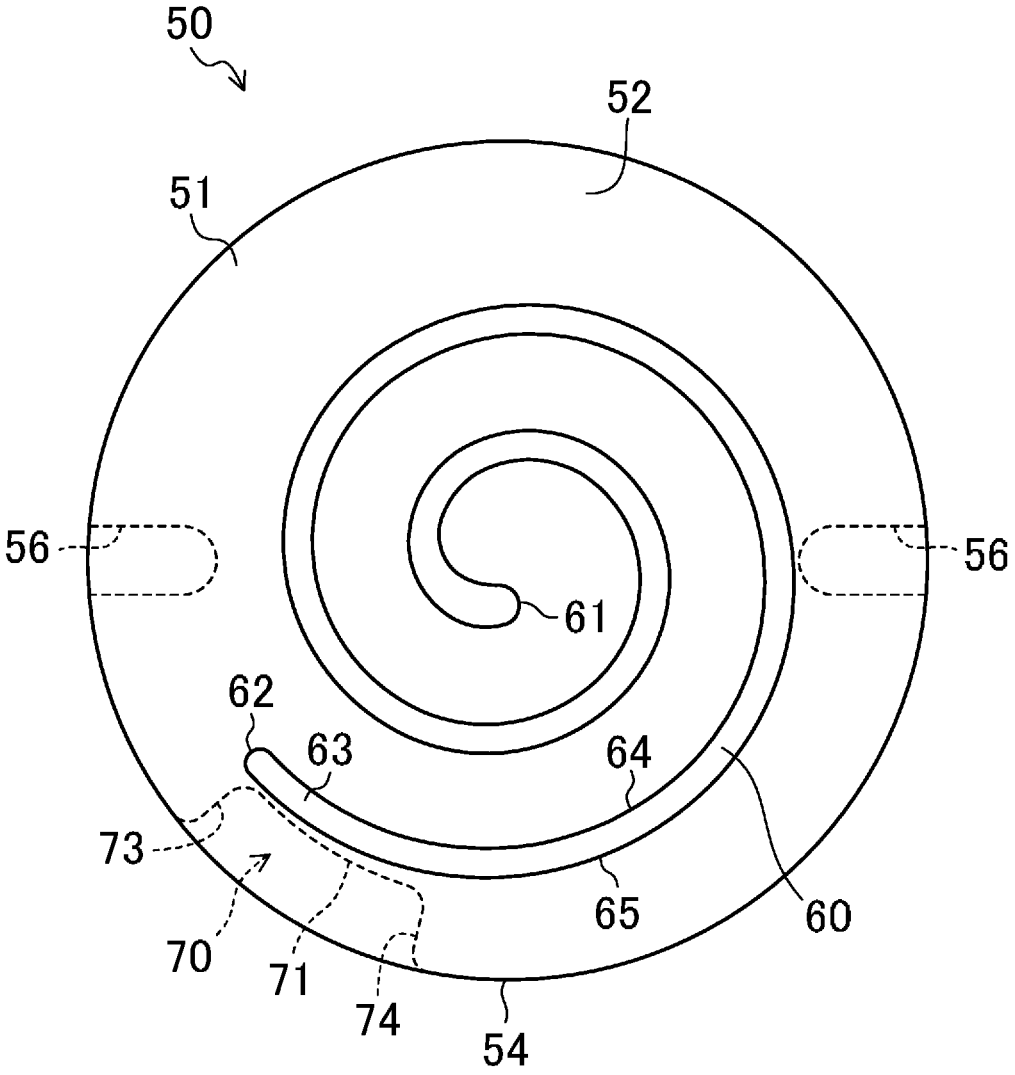
FIG. 14 is a plan view of the orbiting scroll according to the second variation.

Further, as shown in FIG. 14, the rear concave portion (70) of this variation may have a greater length in the circumferential direction of the orbiting end plate (51) than the rear concave portion (70) shown in FIG. 13. The rear concave portion (70) shown in FIG. 14 has approximately the same length in the circumferential direction of the orbiting end plate (51) as the rear concave portion (70) shown in FIG. 5.

In the orbiting scroll (50) of this variation, the inner peripheral wall surface (71) of the rear concave portion (70) is located outside the outer surface (65) of the orbiting lap (60) in the radial direction of the orbiting end plate (51). In the orbiting end plate (51) of the orbiting scroll (50) of this variation, the rear concave portion (70) is arranged outside the outer surface (65) of the orbiting lap (60) in the radial direction of the orbiting end plate (51).

Third Variation

Figure 15:
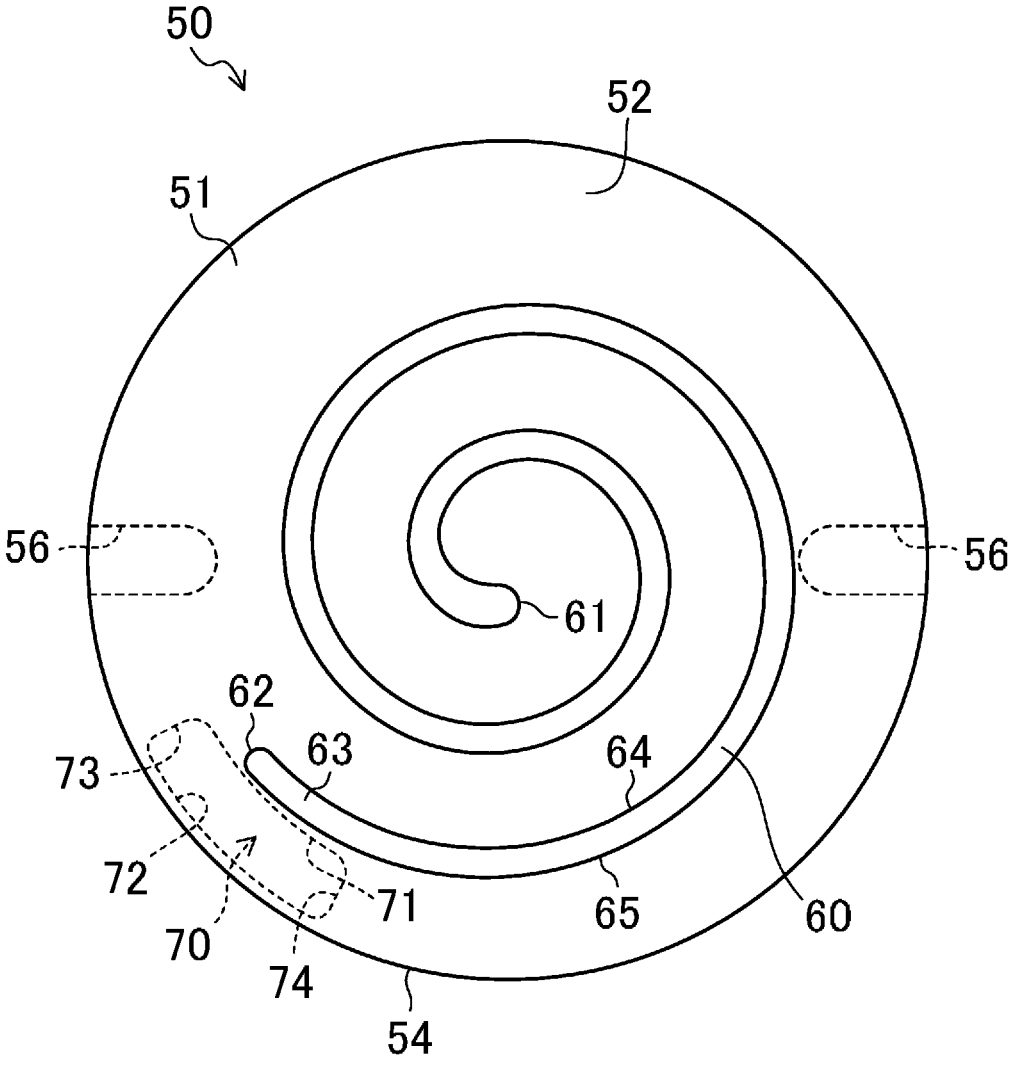
FIG. 15 is a plan view of an orbiting scroll according to a third variation.

As shown in FIG. 15, in the orbiting scroll (50) of the present embodiment, the rear concave portion (70) of the orbiting end plate (51) may open only in the rear surface (53) of the orbiting end plate (51). Specifically, the rear concave portion (70) of this variation does not open in the outer peripheral surface (54) of the orbiting end plate (51), and its outer peripheral wall surface (72) is located inside the outer peripheral surface (54) of the orbiting end plate (51) in the radial direction of the orbiting end plate (51).

Fourth Variation

Figure 16:
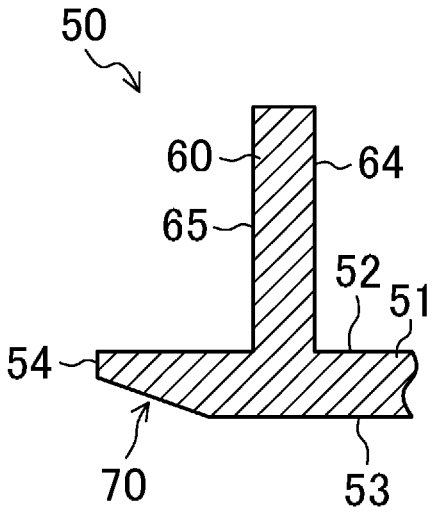
FIG. 16 is a cross-sectional view corresponding to FIG. 7, illustrating an orbiting scroll according to a fourth variation.

As shown in FIG. 16, in the orbiting scroll (50) of the present embodiment, the rear concave portion (70) of the orbiting end plate (51) may be shaped so that its depth gradually decreases toward the inside in the radial direction of the orbiting end plate (51). In this case, the bottom surface (75) of the rear concave portion (70) is inclined.

Fifth Variation

The compression mechanism (30) of the present embodiment is not limited to have an asymmetric lap structure in which the fixed lap (42) is longer than the orbiting lap (60). The compression mechanism (30) of the present embodiment may have a symmetrical lap structure in which the fixed lap (42) and the orbiting lap (60) have the same length.

While the embodiments and variations thereof have been described above, it will be understood that various changes in form and details may be made without departing from the spirit and scope of the claims. The above-described embodiments and variations may be appropriately combined or replaced unless the function of the target of the present disclosure is impaired.

As can be seen from the foregoing, the present disclosure is useful as a scroll compressor.

What is claimed is:

1. A scroll compressor, comprising:

an orbiting scroll having a disk-shaped orbiting end plate and a spiral wall-shaped orbiting lap protruding from a front surface of the orbiting end plate; and a fixed scroll having a spiral wall-shaped fixed lap meshing with the orbiting lap, the orbiting end plate being provided with a rear concave portion that opens in a rear surface and an outer peripheral surface of the orbiting end plate and extends along a winding finish portion of the orbiting lap, the rear concave portion including a bottom surface which is a flat surface, and an inner peripheral wall surface which is a curved surface along the winding finish portion of the orbiting lap, wherein R−(Re+te)≤W≤R−(Re−2te), W representing a width of the rear concave portion in a radial direction of the orbiting end plate, and R, Re, and te respectively representing distances on a straight line passing through an outemost peripheral end of an outer surface of the orbiting lap and a center of the orbiting end plate, with R being a distance from the center to the outer peripheral surface of the orbiting end plate, Re being a distance from the center to the outer surface of the orbiting lap, and te being a thickness of the orbiting lap.

2. The scroll compressor of claim 1, wherein an extending direction of the orbiting lap is a direction from a winding start end of the orbiting lap to a winding finish end of the orbiting lap along the orbiting lap, and the whole rear concave portion is formed behind the winding finish end of the orbiting lap in the extending direction of the orbiting lap.

3. The scroll compressor of claim 1, wherein an extending direction of the orbiting lap is a direction from a winding start end of the orbiting lap to a winding finish end of the orbiting lap along the orbiting lap, and the rear concave portion extends over a front side and a rear side of the winding finish end of the orbiting lap in the extending direction of the orbiting lap.

4. The scroll compressor of claim 3, wherein the rear concave portion has a first portion spreading rearward of the winding finish end of the orbiting lap in the extending direction of the orbiting lap, and a second portion spreading forward of the winding finish end of the orbiting lap in the extending direction of the orbiting lap, the first portion having a length equal to or greater than the second portion in a circumferential direction of the orbiting end plate.

5. The scroll compressor of claim 1, wherein the inner peripheral wall surface of the rear concave portion is located outside an outer surface of the orbiting lap in a radial direction of the orbiting end plate.

6. The scroll compressor of claim 1 wherein the rear concave portion extends over an inner side and outer side of an outer surface of the winding finish portion of the orbiting lap in a radial direction of the orbiting end plate.

7. The scroll compressor of claim 1, wherein $0.5 \leq D/T \leq 0.8$,

D represents a depth of the rear concave portion, and

T represents a thickness of the orbiting end plate.

* * * * *